US005788415A

United States Patent [19]

Chen

[11] Patent Number: 5,788,415

[45] Date of Patent: Aug. 4, 1998

[54] INTEGRALLY-ENCASED DIVING CONTROL VALVE MEANS

[76] Inventor: Frankie Chen, P.O. Box 55-846, Taipei, Taiwan

[21] Appl. No.: 581,999

[22] Filed: Jan. 2, 1996

[51] Int. Cl.[6] ..... B63C 11/02

[52] U.S. Cl. ..... 405/186; 441/89; 441/96; 116/142 FP

[58] Field of Search ..... 405/185, 186; 441/89, 90, 92, 96; 116/26, 24, 137 R, 139, 140, 142 FP, 142 R

[56] References Cited

U.S. PATENT DOCUMENTS

| | | | |
|---|---|---|---|
| 4,720,281 | 1/1988 | Matsuoka | 405/186 |
| 4,852,510 | 8/1989 | Joseph, Jr. et al. | 116/137 R X |
| 4,950,107 | 8/1990 | Hancock et al. | 405/186 |
| 4,998,499 | 3/1991 | Nordbeck | 116/137 R X |
| 5,022,790 | 6/1991 | Stevenson | 405/186 |
| 5,256,094 | 10/1993 | Canna | 441/96 |
| 5,520,485 | 5/1996 | Hermansen | 405/186 |

FOREIGN PATENT DOCUMENTS

| | | | |
|---|---|---|---|
| 218996 | 9/1989 | Japan | 405/186 |

*Primary Examiner*—Tamara L. Graysay
*Assistant Examiner*—Frederick L. Lagman

[57] ABSTRACT

A diving control valve device includes a casing having a nozzle device fitted in the casing for connecting an air source from an air tank, an inflating valve device, a deflating valve device and an alarming valve device integrally encased in the casing for forming a compact valve unit for an ergonomic operation of the inflating valve, deflating valve and alarming valve by a diver's single hand and also for decreasing the frictional water resistance by the compact volume of the integrally formed valve unit in order for facilitating the diving velocity and enhancing the diving maneuverability.

6 Claims, 8 Drawing Sheets

INTEGRALLY-ENCASED DIVING CONTROL VALVE MEANS

BACKGROUND OF THE INVENTION

U.S. Pat. Nos. 4,950,107 and 5,106,236 to David A. Hancock disclosed an audible alarm device for divers including an alarm apparatus (30) connected between the hose (14) to the air tank (10) and the inflation/exhaust valve assembly (15) for signaling uses by divers.

However, such an audible alarm device may have the following drawbacks:

1. The alarm apparatus (30) including the noise maker portion (32), the body portion (34) and the connector (36) is separated from the inflation/exhaust valve assembly (15) including the inflator button (19) and deflation button (20), not integrally formed as a compact unit. Therefore, it is difficult to selectively operate the inflator button (19), the deflation button (20) and the alarm apparatus (30) by a diver's single hand since his single hand (or palm) can not completely hold and depress the inflator button (19), the deflation button (20), and the alarm button (80), thereby influencing a diver's maneuverability especially when the diver's one hand carries an equipment such as a fishing spear, underwater camera or the others.

2. The divergently orienting alarm apparatus (30), the inflator button (19), the deflation button (20) and the mouth piece (22), forming a configuratin like a tree and its branches, will increase the frictional water resistance to decrease the diving velocity on the viewpoint of fluid mechanics when diving underwater.

3. The so many separated parts of the alarming device, inflation and deflation buttons, when manually assembled, will increase the production inconvenience and cost.

The present inventor has found the drawbacks of the conventional alarm device and inflation/exhaust devices of the scuba diving equipments, and invented the integrally-encased control valve means.

SUMMARY OF THE INVENTION

The object of the present invention is to provide a diving control valve device including: a casing having a nozzle device fitted in the casing for connecting an air source from an air tank, an inflating valve device, a deflating valve device and an alarming valve device integrally encased in the casing for forming a compact valve unit for an ergonomic operation of the inflating valves deflating valve and alarm valve by a diver's single hand and also for decreasing the frictional water resistance by the compact volume of the integrally formed valve unit in order for facilitating the diving velocity and enhancing the diving maneuverability.

DETAILED DESCRIPTION

Figure 1:
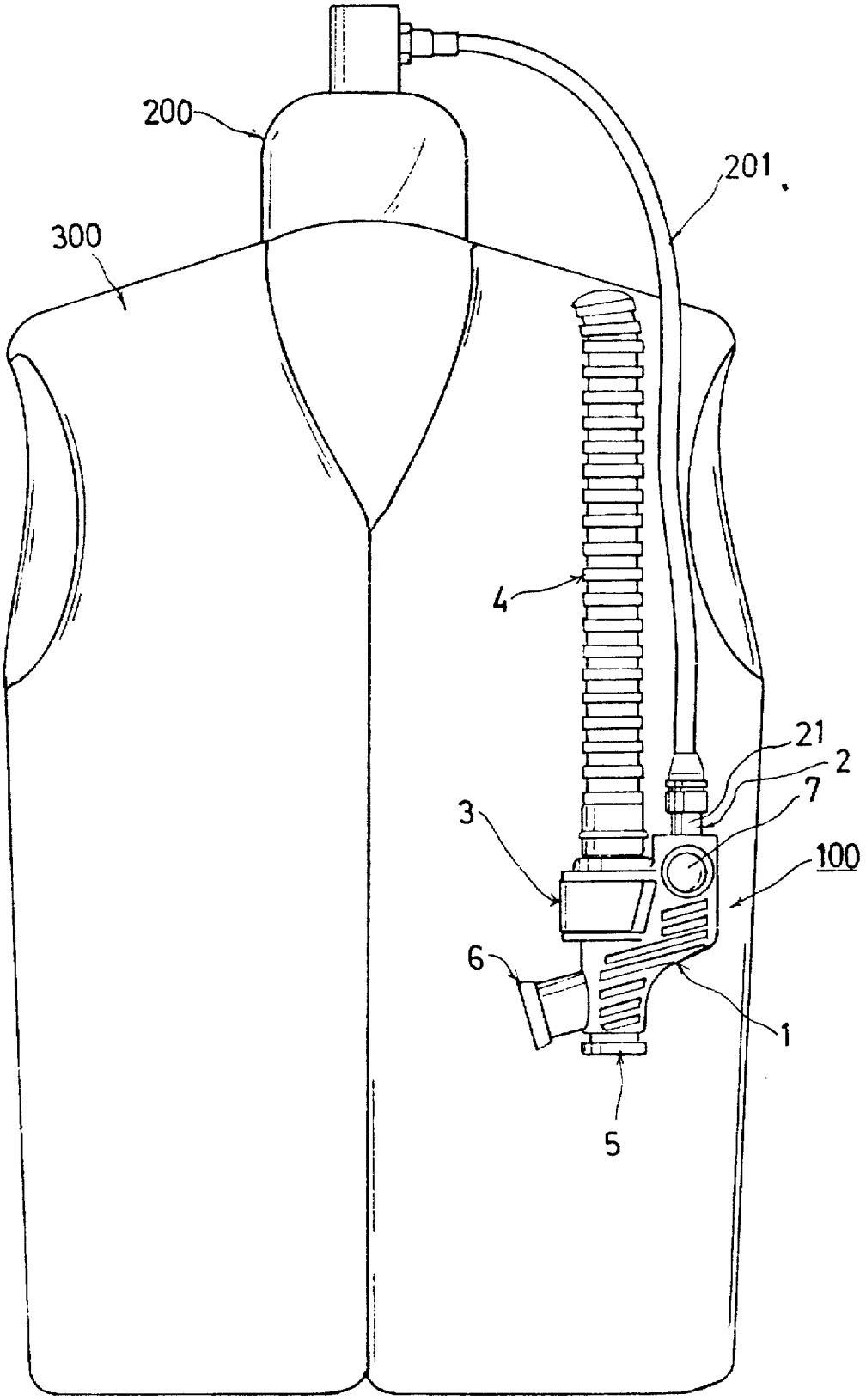
FIG. 1 is an illustration of the present invention connected to an air tank and a buoyancy compensator jacket.

As shown in FIGS. 1–4, the present invention comprises: a diving control valve means 100 connected to an air tank 200 and connected to a buoyancy compensator jacket or vest 300.

The diving control valve means 100 includes: a casing 1 having a nozzle body 11 having a hollow bore portion 12 longitudinally formed through the nozzle body 11 for fitting the nozzle means 2 in the bore portion 12 for directing an air source from the air tank 200 through an air hose 201, a main body 13 integral and contiguous to the nozzle body 11 having a central duct 14 longitudinally formed through the main body 13 defining a longitudinal axis 130 in the duct 14 and having a filling adapter 15 formed on a lower end portion of the main body 13 for connecting an input end portion 41 of a flexible hose 4 connected to the buoyancy compensator jacket 300, an inflating means 3 transversely formed on a middle portion of the main body 13 through a stem hole 131 formed in the main body and the nozzle body 11 of the casing 1, a deflating means 5 formed on an upper portion of the main body 13 of the casing 1, a mouth piece 6 fixed on a mouth-piece connector 17 formed on an upper side portion of the main body 13 adjacent to the deflating means 5, and an alarming means 7 having an alarm button 71 fixed in an alarm connector 18 formed on a lower portion of the nozzle body 11 and a horn 73 secured in a horn connector 19 formed on the lower portion of the nozzle body 11 with the horn connector 19 aligned with the alarm connector 18 to define a latitudinal axis 190 projectively perpendicular to the longitudinal axis 130 defined in the main body 13, whereby upon holding of the casing 1 by positioning a diver's thumb T on the inflating means 3 and the diver's index finger I on the deflating means 5, an inflation and deflation of the control valve means 100 will be ergonomically manipulated by a single hand of the diver (FIG. 8); and upon a twisting or rotation by rotating the horn connector 19 by the diver's ring finger R and little finger L about the longitudinal axis 130 (FIG. 9) and by positioning the diver's thumb T on the alarming means 7, the alarming means 7 will be conveniently actuated by the single hand of the diver.

Figure 6:
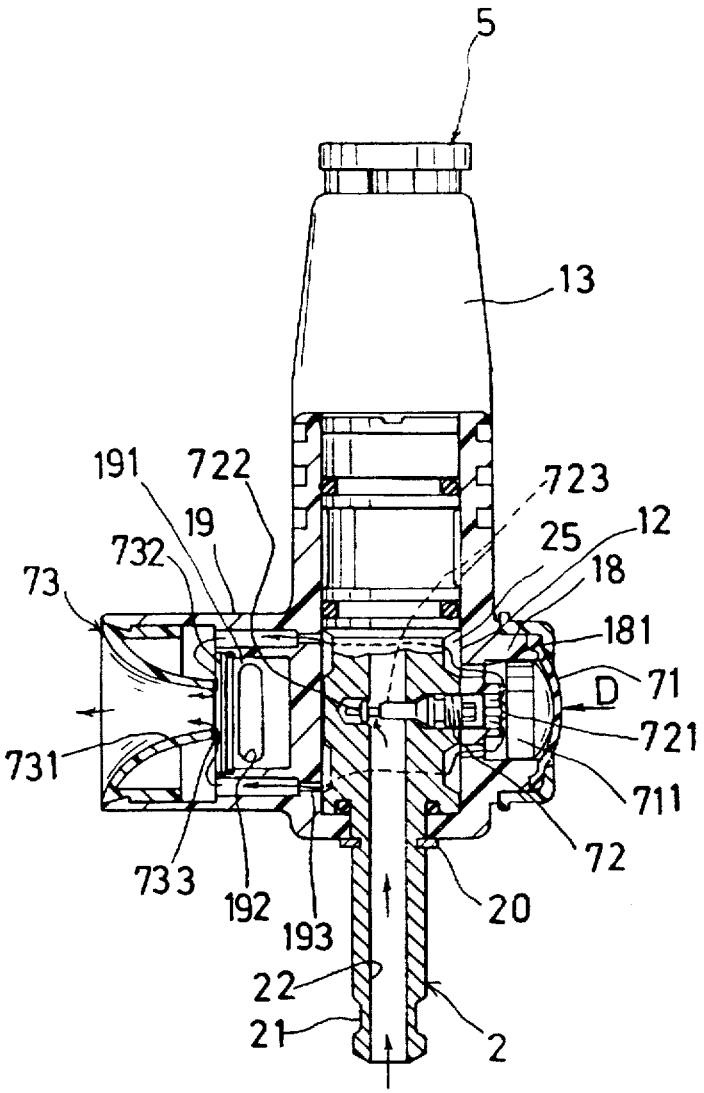
FIG. 6 shows an alarming condition of the present invention following FIG. 4.

The nozzle means 2 includes: a nozzle adapter 21 formed on a lower end portion of the nozzle means 2 to connect the air hose 201 of the air tank 200 having a bottom sealing ring 251 sealing a lower portion of the nozzle means 2 in the lower portion of the nozzle body 11 and having a retainer 20 retaining the lower portion of the nozzle means 2 with the nozzle body 11 of the casing 1, a central hole 22 longitudinally formed through the nozzle means 2, an inflating-valve hole 23 transversely formed in an upper portion of the nozzle means 2 for fixing an inflating valve 33 of the inflating means 3 in the inflating-valve hole 23 having an upper and a lower sealing ring 231, 232 sealing the inflating valve 33 in the nozzle body 11, an alarm-valve hole 24 transversely formed in a lower portion of the nozzle means 2 for fitting an alarming valve 72 of the alarming means 7 in the alarm-valve hole 24 having at least a recess portion 25 recessed in a lower portion of the nozzle means 2 for communicating the alarm connector 18 and the horn connector 19 for actuating the alarming means 7 (FIG. 6), and a spare inflating adapter 26 formed on an upper portion of the nozzle means 2 and sealed by an upper sealing ring 261 at an upper portion of the nozzle body 11 of the casing 1 for inflating any inflatable equipments.

Figure 5:
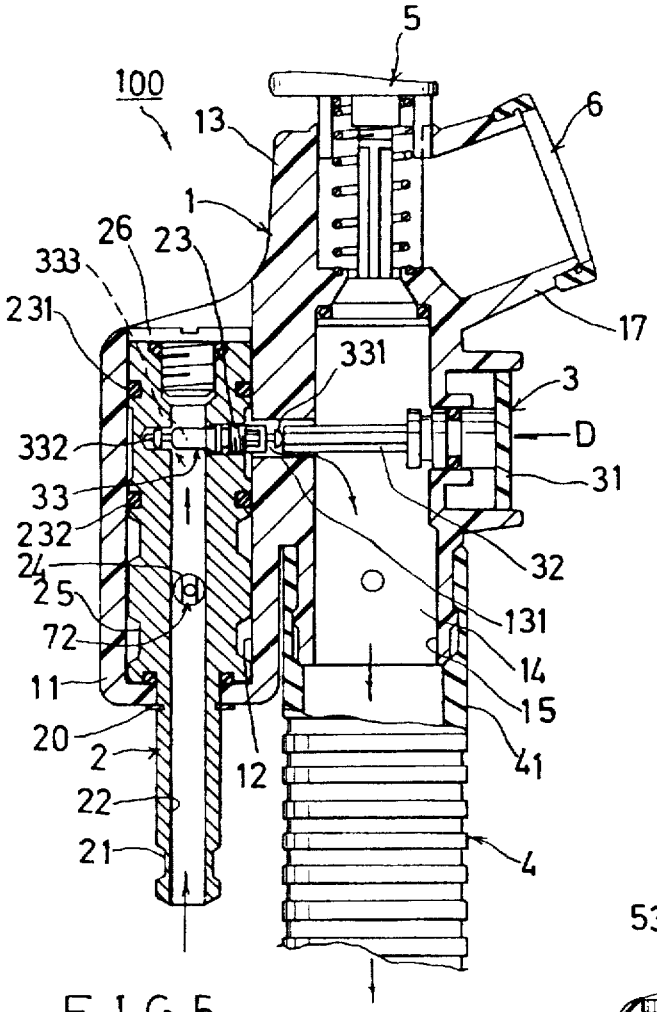
FIG. 5 shows an inflating condition of the present invention following FIG. 3.

The inflating means 3 includes: an inflating button 31 reciprocatively mounted on a middle portion of the main body 13 as sealed by a sealing ring 311, an inflating rod 32 slidably held in the stem hole 131 in the main body 13 to receive a depression (D) by the inflating button 31 as actuated, and an inflating valve 33 having a valve stem 331 depressible by the inflating rod 32 and the inflating button 31 and a valve plug 332 normally sealing (as effected by a spring (not shown) in the valve 33) an air passage 333 formed in the inflating valve 33 and communicated with the central hole 22 in the nozzle means 2, the stem hole 131 and the central duct 14 in the main body 13, and operatively opening the air passage 333 upon a depression (D) of the inflating button 31 (FIG. 5) to direct air from the air tank 200 through the air hose 201, the central hole 22, the air passage 333, the central duct 14 and the flexible hose 4 into the buoyancy compensator (BC) jacket 300 for adjusting buoyancy underwater or on a water level.

The deflating means 5 includes: a deflating button 51 secured with a deflating stem 52 reciprocatively held in an upper portion of the main body 13 of the casing, a plug 53 secured to the stem 52 and normally seating on a valve seat 16 formed in the main body 13 for sealing a valve opening 161 in an upper portion of the main body 13, and a restoring spring 54 retained between the deflating button 51 and the valve seat 16 for normally urging the deflating button 51 upwardly for closing the valve opening 161 when inflating the jacket 300. A sealing ring 531 may be provided for ensuring a well sealing of the valve opening 161 and valve seat 16. The valve opening 161 is communicated with the mouth piece 6 for discharging air (Di) outwardly as solid line shown in FIG. 7 when depressing (D) the deflating button 51 to lower the rod 32 and plug 53 to open the valve opening 161 so as to deflate the jacket 300 for reducing its buoyancy underwater.

Figure 7:
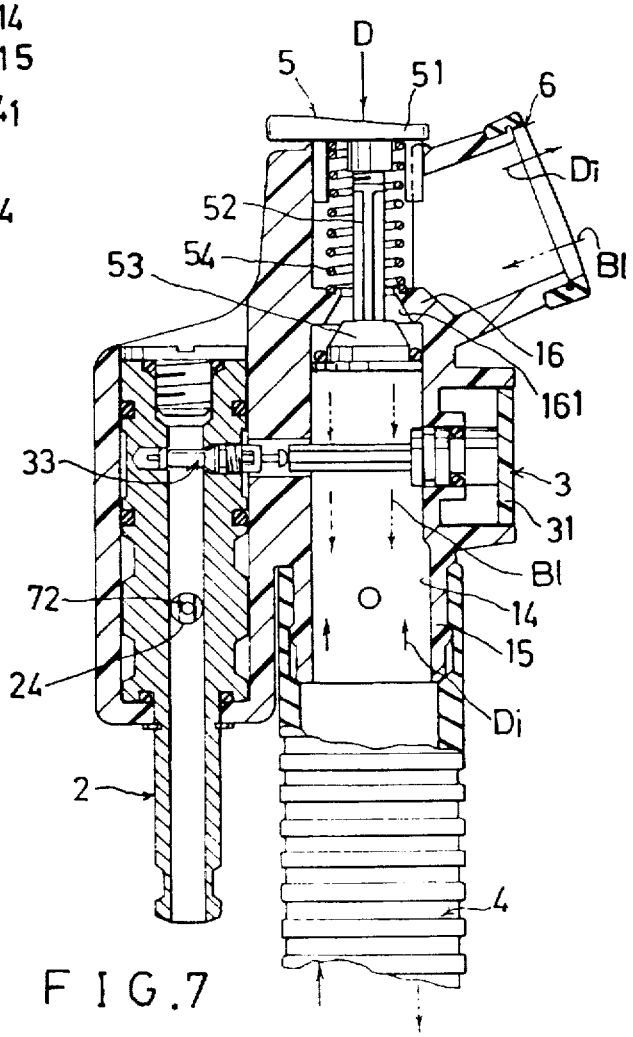
FIG. 7 shows a deflated condition of the present invention.

The deflating button 51 may also be depressed to open the plug 53 to allow an inward blowing (Bl) of air from a diver's mouth (not shown), when the air tank is exhausted, to boost air into the BC jacket 300 as shown in dotted line of FIG. 7.

The materials for making the elements of the present invention are not limited. However, the casing 1 may be integrally formed by plastic molding processes, or made by other materials and methods.

Figure 2:
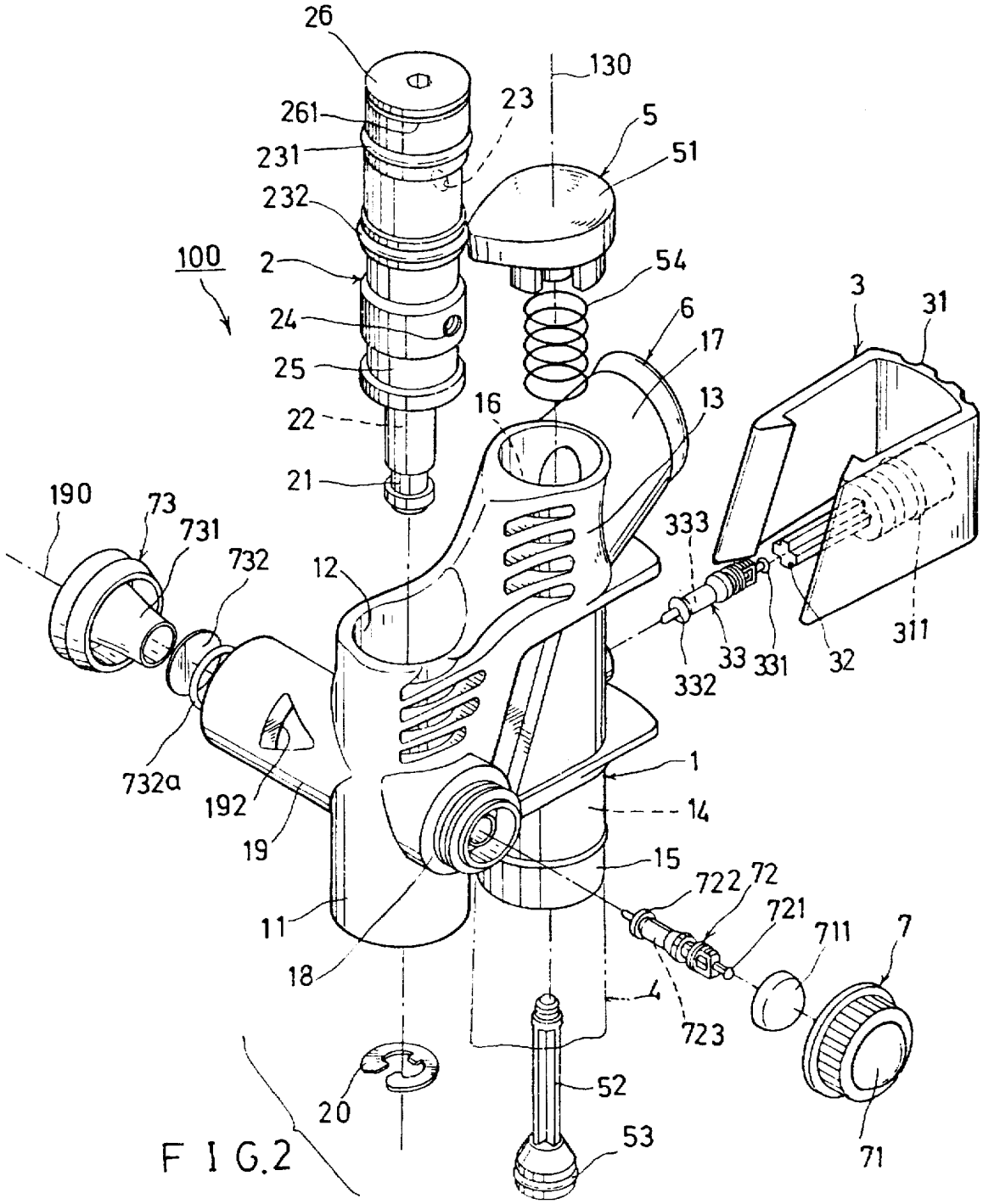
FIG. 2 is an exploded view showing the elements in construction of the present invention.
Figure 3:
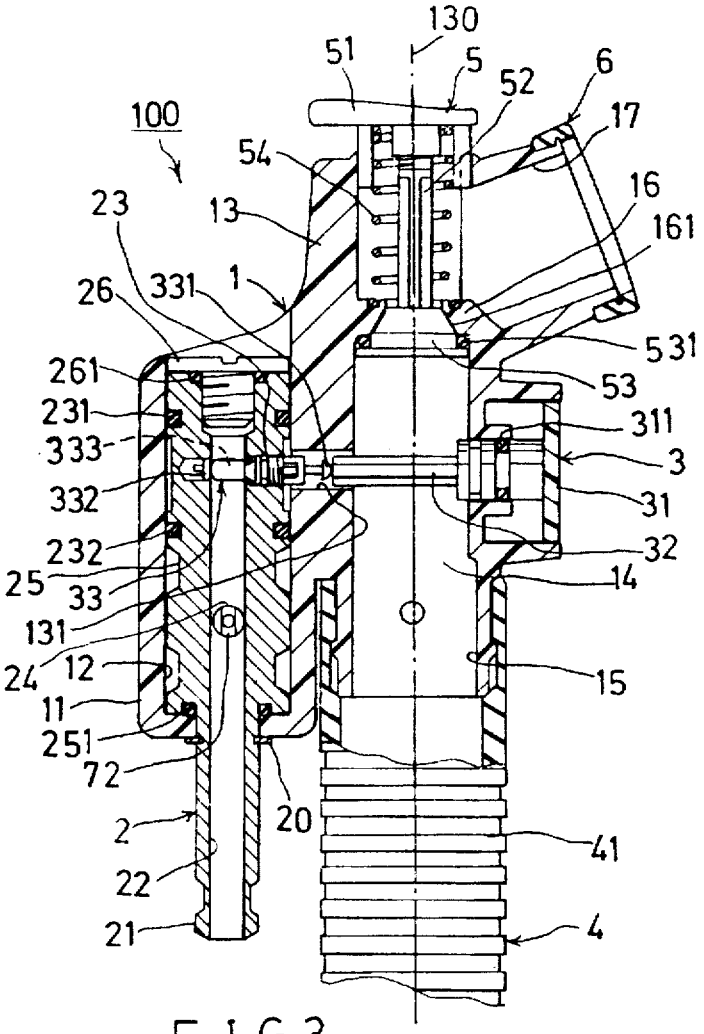
FIG. 3 is a longitudinal sectional drawing of the present invention showing the nozzle means, the deflating means and the mouth piece when not actuated.
Figure 4:
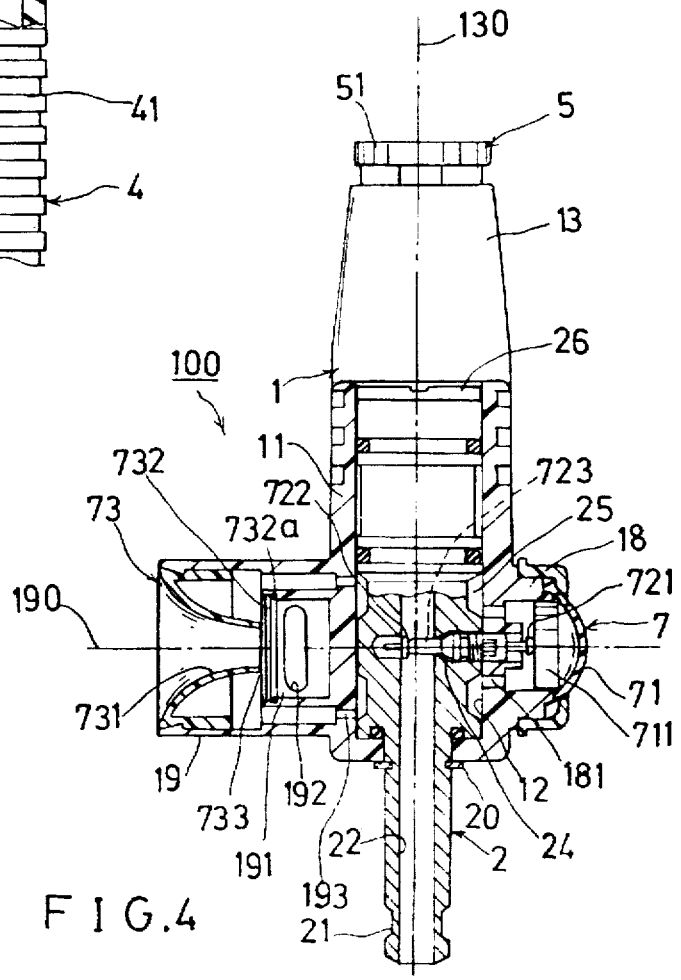
FIG. 4 is a sectional drawing of the alarming means of the present invention when not actuated.

The alarming means 7 includes: an alarm button 71 which may be a rubber or plastic cap member formed on the alarm connector 18; an alarming valve 72 formed in the alarm-valve hole 24 in the nozzle means 2 having a valve stem 721 depressible by the alarm button 71 through a depressing member 711 embedded within the alarm button 71 and a valve plug 722 normally sealing (by a spring, not shown, in the alarming valve 72) an air passage 723 which is formed through the alarming valve 72 and communicated with the central hole 22 in the nozzle means 2, the air opening 181 formed in the alarm connector 18, the recessed portion 25 in the nozzle means 2 within the bore portion 12 of the nozzle body 11 and at least an air hole 193 formed in the horn connector 19 opposite to the alarm connector 18; and a horn 73 having a horn member 731 secured in an outer portion of the horn connector 19, a diaphragm 732 secured on a resonance chamber 191 formed in the horn connector 19 by a shock-absorbing ring 732*a* as shown in FIGS. 2 and 4 and communicated with the air holes 193 and at least a side opening 192 notched in a side portion of the horn connector 19 and with the diaphragm 732 positioned inside the horn member 731 to define an air aperture 733 between the horn member 731 and the diaphragm 732, whereby upon depression (D) of the alarming button 71 to open the valve 72, the air from the air tank 200 will rapidly flow into the air aperture 733 through the central hole 22, air passage 723, the air opening 181, the bore portion 12, recessed portion 25, the air hole 193 to vibrate the diaphragm 732 to produce noisy sound through the horn member 731 for alerting and signaling purpose (FIG. 6), and the resonance chamber 191 may also cause a loud sound in the resonance chamber through the side opening 192.

Figure 8:
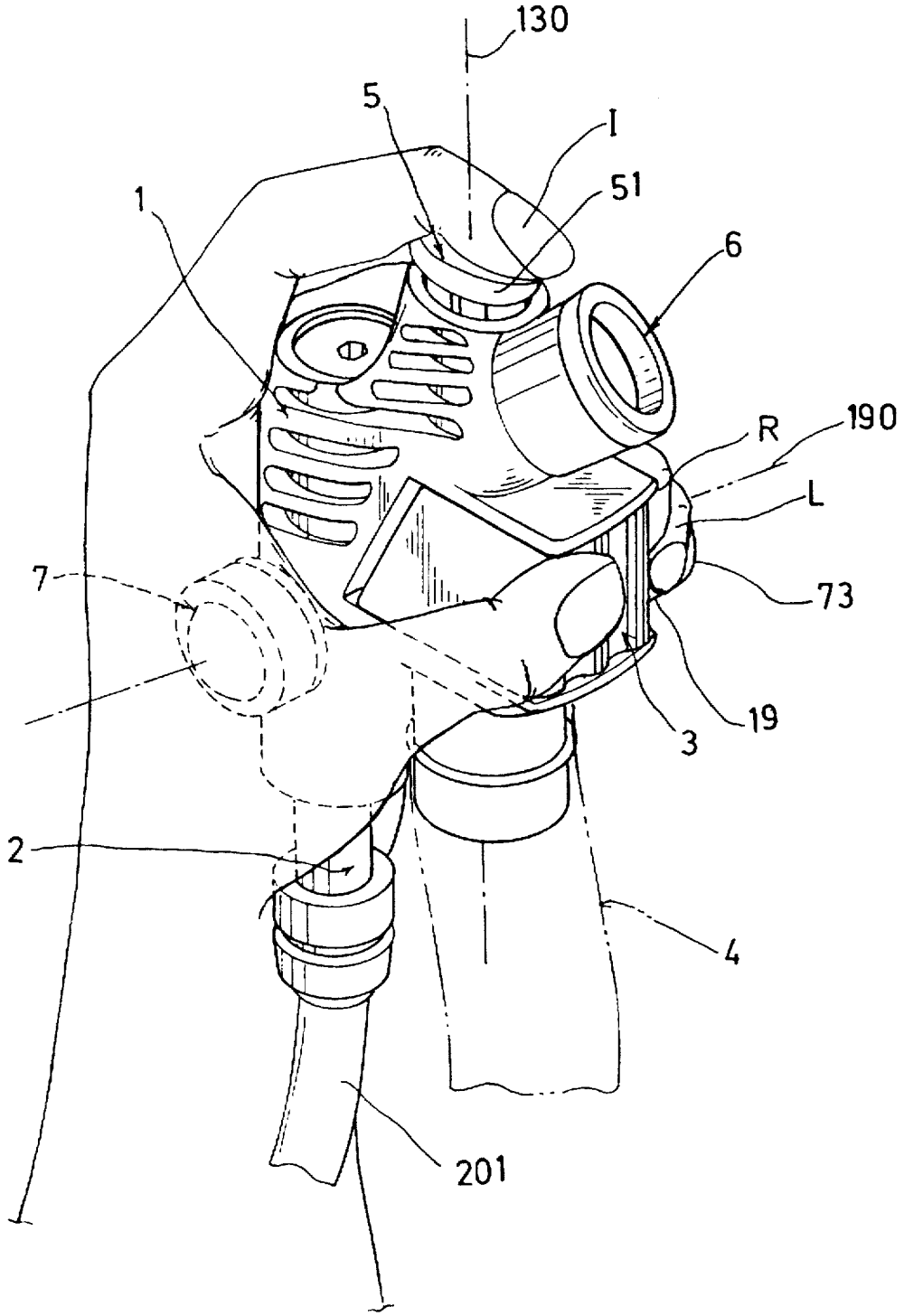
FIG. 8 shows an operation of the present invention manipulated by a diver's single hand for inflation and deflation.
Figure 9:
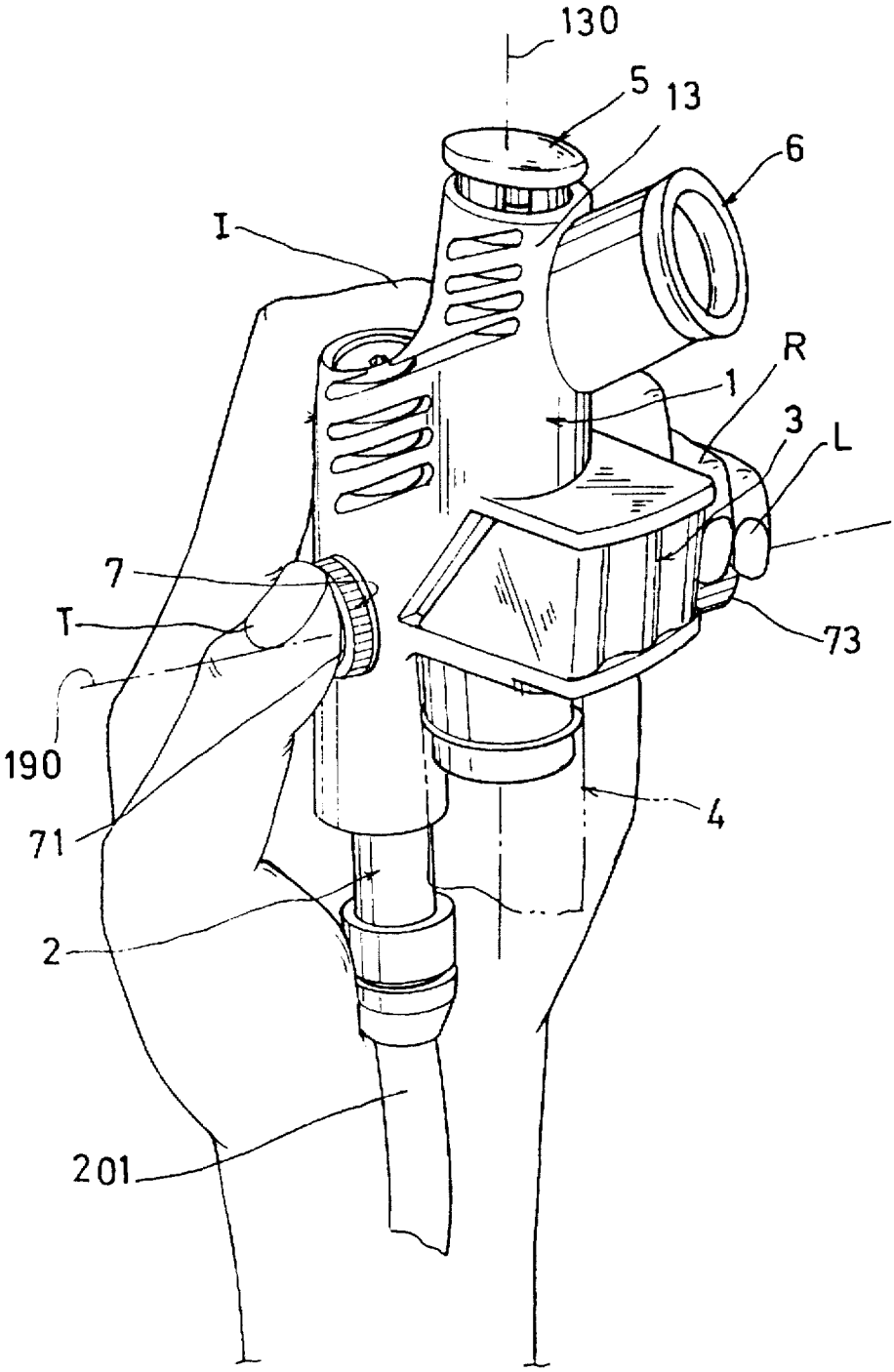
FIG. 9 shows an operation of the present invention when actuating the alarming means following the operation of FIG. 8.

By the way, the present invention may be conveniently ergonomically manipulated for inflation, deflation and alarm actuation for multiple uses just operated by a diver's single hand as shown in FIGS. 8, 9.

Figure 10:
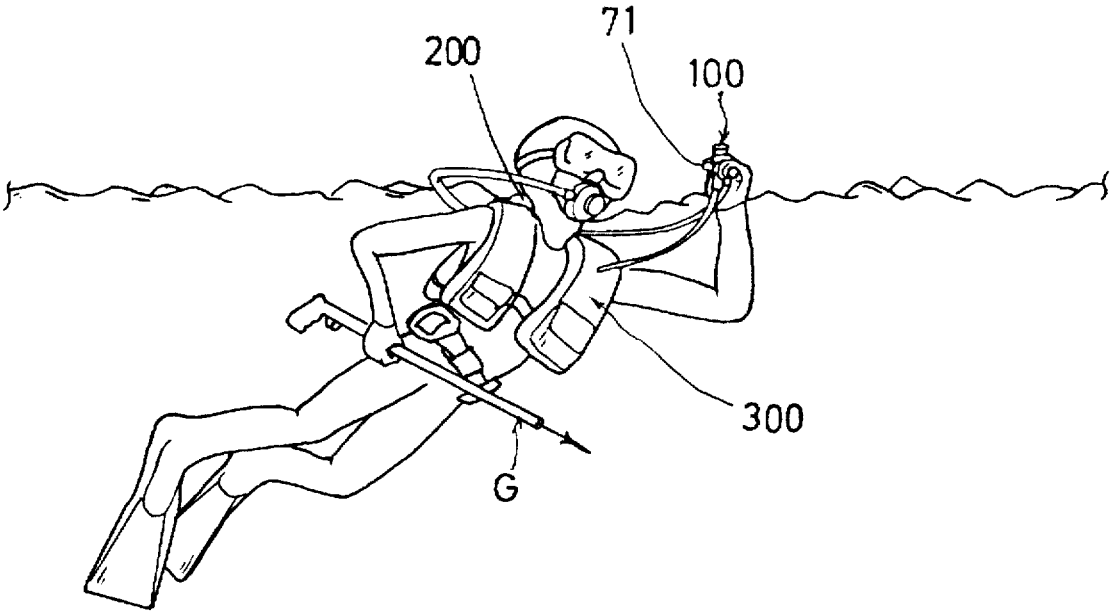
FIG. 10 shows a signaling operation of a diver when floating on a water level.

As shown in FIG. 10, when one hand of the diver is holding a fishing spear G, his another hand may operate the inflating button 31 and deflating button 51 for adjusting the buoyancy of the B.C. jacket for well control of the diving, and when he encounters a dangerous situation he may also depress the alarm button 71 by the same single hand for signaling purpose such as for asking help when becoming ill or dangerous such as being attacked by a shark (not shown).

The present invention is superior to a conventional alarm device and inflation/exhaust valve assembly of a scuba apparatus with the following advantages:

1. All elements including the alarming means 7, the inflating means 3, the deflating means 5, the mouth piece 6 and the spare inflating adapter 26 are integrally encased in the integrally-formed casing 1 for a compact structure, easily manipulated and ergonomically operated for enhancing a diving maneuverability.

2. The compact contour of the integrally formed structure may reduce its water frictional resistance, accelerating the diving and swimming velocity for a diver in accordance with fluid mechanics.

3. Assembly and production cost can be greatly reduced due to the integrally-encased structure.

4. The alarm and horn connectors 18, 19 are generally perpendicular to the casing for an easy depression operation of the alarming means 7 by rotating the alarm and horn connectors, serving as a steering handle and allowing a single hand (single palm) operation by converting an inflation/deflation work (as shown in FIG. 8) to an alarming or signaling operation (FIG. 9), and vice versa. The single-hand operation of this invention may also enhance the diving maneuverability and signaling convenience.

The present invention may be modified without departing from the spirit and scope as claimed in the present invention.

I claim:

1. A diving control valve means comprising:

a casing including a nozzle body having a hollow bore portion longitudinally formed through the nozzle body for fitting a nozzle means in the bore portion for directing an air source from an air tank through an air hose, a main body integral and contiguous to the nozzle body having a central duct longitudinally formed through the main body defining a longitudinal axis in the central duct and having a filling adapter formed on a lower end portion of the main body for connecting an input end portion of a flexible hose connected to a buoyancy compensator jacket, an inflating means transversely formed in a middle portion of the main body and the nozzle body of the casing, a deflating means formed on an upper portion of the main body of the casing, a mouth piece formed on an upper side portion of the main body adjacent to the deflating means, and an alarming means having an alarm button fixed in an alarm connector formed on a first lower portion of the nozzle body and a horn secured in a horn connector formed on a second lower portion of the nozzle body with the horn connector projectively aligned with the alarm connector to define a latitudinal axis at a center of the alarm and horn connectors to be projectively perpendicular to the longitudinal axis defined in the main body, whereby upon holding of the casing by positioning a diver's thumb on the inflating means and the diver's index finger on the deflating means, an inflation and deflation of the control valve means is ergonomically manipulated by a single hand of the diver; and upon a rotation of the horn connector by the diver's ring finger and little finger about the longitudinal axis to allow a depression by the diver's thumb on the alarming means, the alarming means is conveniently actuated by a single hand of the diver.

2. A diving control valve means according to claim 1, wherein said nozzle means includes: a nozzle adapter formed on a lower end portion of the nozzle means to connect the air hose of the air tank, a central hole longitudinally formed through the nozzle means, an inflating-valve hole transversely formed in an upper portion of the nozzle means for fixing an inflating valve of the inflating means in the inflating-valve hole, and an alarm-valve hole transversely formed in a lower portion of the nozzle means for fitting an alarming valve of the alarming means in the alarm-valve hole having at least a recess portion recessed in a lower portion of the nozzle means for communicating the alarm connector and the horn connector for actuating the alarming means.

3. A diving control valve means according to claim 2, wherein said nozzle means includes: a spare inflating adapter formed on an upper portion of the nozzle means at an upper portion of the nozzle body of the casing for supplying air source to an inflatable equipment.

4. A diving control valve means according to claim 1, wherein said inflating means includes: an inflating button reciprocatively mounted on a middle portion of the main body, an inflating rod slidably held in a stem hole formed in the main body to receive a depression on the inflating button, and an inflating valve having a valve stem depressible by the inflating rod and the inflating button and a valve plug normally sealing an air passage which is formed in the inflating valve and communicated with a central hole in the nozzle means, the stem hole and the central duct in the main body, and operatively opening the air passage upon a depression of the inflating button to direct air from the air tank through the air hose, the central hole in the nozzle means, the air passage in the inflating valve, the central duct in the main body and the flexible hose into the buoyancy compensator jacket for adjusting a buoyancy of a diver underwater and on a water level.

5. A diving control valve means according to claim 1, wherein said deflating means includes: a deflating button secured with a deflating stem reciprocatively held in an upper portion of the main body of the casing, a plug normally seating on a valve seat formed in the main body for sealing a valve opening in an upper portion of the main body, and a restoring spring retained between the deflating button and the valve seat for normally urging the deflating button upwardly for closing the valve opening when inflating the buoyancy compensator jacket, said valve opening communicated with the mouth piece for discharging air outwardly when depressing the deflating button to lower the deflating rod and the plug to open the valve opening to deflate the buoyancy compensator jacket for reducing buoyancy underwater.

6. A diving control valve means according to claim 1, wherein said alarming means includes: an alarm button formed on the alarm connector; an alarming valve formed in an alarm-valve hole in the nozzle means having a valve stem depressible by the alarm button and a valve plug normally sealing an air passage which is formed through the alarming valve and communicated with a central hole in the nozzle means, an air opening formed in the alarm connector, a recessed portion in the nozzle means within the bore portion of the nozzle body and an air hole formed in the horn connector opposite to the alarm connector; and a horn having a horn member secured in an outer portion of the horn connector, a diaphragm secured on a resonance chamber formed in the horn connector and communicated with the air hole and at least a side opening notched in a side portion of the horn connector and with the diaphragm positioned inside the horn member to define an air aperture between the horn member and the diaphragm, whereby upon depression of the alarming valve to open the alarming valve, an air stream from the air tank will rapidly flow into the air aperture to vibrate the diaphragm to produce noisy sound through the horn member for signaling purpose, and the resonance chamber causing a loud sound from the resonance chamber and the side opening in the horn connector.

* * * * *